US009422683B2

(12) United States Patent
O'Hare

(10) Patent No.: US 9,422,683 B2
(45) Date of Patent: Aug. 23, 2016

(54) FOLDABLE SCOOPER

(71) Applicant: Doreen O'Hare, Laguna Nigel, CA (US)

(72) Inventor: Doreen O'Hare, Laguna Nigel, CA (US)

( * ) Notice: Subject to any disclaimer, the term of this patent is extended or adjusted under 35 U.S.C. 154(b) by 0 days.

(21) Appl. No.: 14/218,569

(22) Filed: Mar. 18, 2014

(65) Prior Publication Data

US 2015/0267366 A1 Sep. 24, 2015

(51) Int. Cl.
*A01K 29/00* (2006.01)
*E01H 1/12* (2006.01)

(52) U.S. Cl.
CPC ..... *E01H 1/1206* (2013.01)

(58) Field of Classification Search
CPC ..... E01H 1/1206; A01B 1/02; B25G 3/02; B25G 3/18; A47L 13/52; F24B 15/06
USPC ..... D32/74; D7/691; 294/1.3
See application file for complete search history.

(56) References Cited

U.S. PATENT DOCUMENTS

| | | | | |
|---|---|---|---|---|
| 1,484,725 | A * | 2/1924 | Lewis | 15/257.4 |
| 4,641,873 | A * | 2/1987 | Nurnberger | 294/1.4 |
| 5,473,790 | A * | 12/1995 | Desmarais | 15/257.7 |
| 5,820,179 | A * | 10/1998 | Tsou | 294/1.4 |
| 7,188,878 | B1 * | 3/2007 | Kraus | 294/1.4 |
| 7,401,826 | B1 * | 7/2008 | Marrett | 294/1.4 |
| 2006/0214442 | A1 * | 9/2006 | Jones | 294/1.4 |
| 2008/0092321 | A1 * | 4/2008 | Lin | 15/257.7 |
| 2010/0176611 | A1 * | 7/2010 | Merino-Garcia | 294/1.3 |

FOREIGN PATENT DOCUMENTS

GB 2168599 A * 6/1986

* cited by examiner

*Primary Examiner* — Stephen Vu

(57) ABSTRACT

Disclosed herein are embodiments of a foldable scooper for use in picking up animal waste. The scooper can be folded and configured to attach to a leash or be inserted into a user's pocket, thereby making it hands free. In some embodiments, the foldable scooper can be wrapped by a waste bag, thereby allowing a user to pick up animal waste without ever coming in contact with the waste.

22 Claims, 5 Drawing Sheets

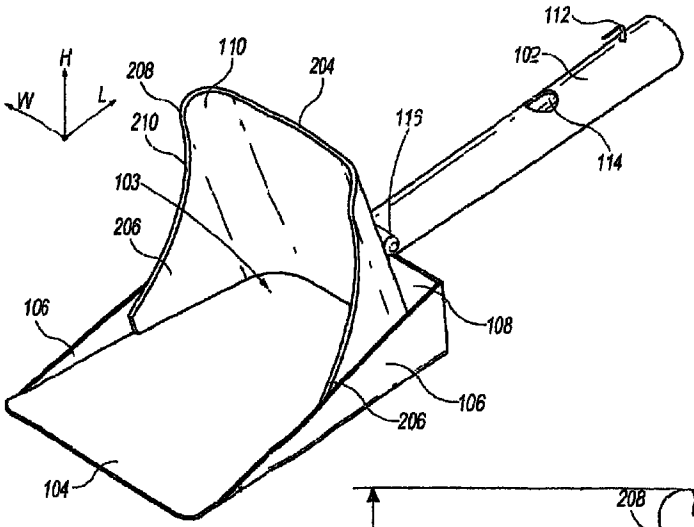
FIG. IA
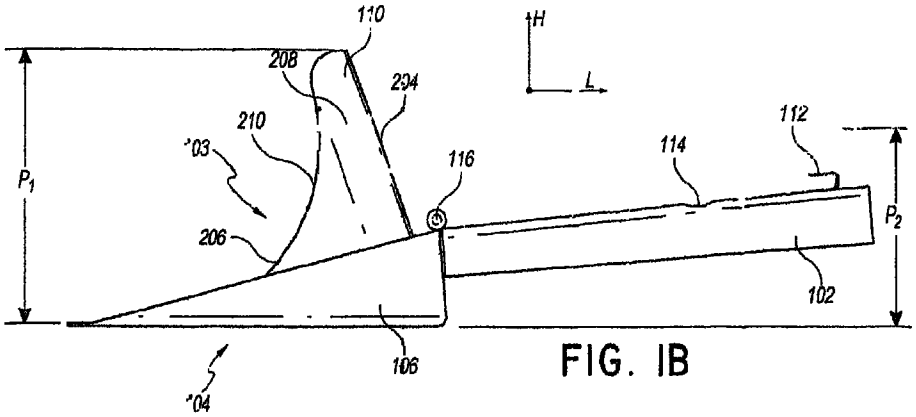
FIG. IB

FOLDABLE SCOOPER

BACKGROUND

1. Field

The present disclosure relates to devices and methods related to a foldable scooper, such as a scooper used to clean after a dog.

2. Description of the Related Art

Many varieties of scoopers for animal waste exist, employing a variety of configurations. However, such systems and certain components thereof have various limitations and disadvantages.

SUMMARY

Disclosed herein is a portable scooping system, said system can comprise a scoop portion comprising, a back wall section, at least two side wall sections connected to the back wall section, and at least one base section connecting the back wall section and the at least two side wall sections, a guard portion configured to extend at least partially over the scoop portion to create a pocket formed between the sidewall sections and base section of the scoop portion and the guard portion, and a handle portion configured to rotatably connect with the back wall section, wherein the handle portion is configured to extend generally away from the scoop portion in an open position, and is configured to nest generally in the scoop portion in the closed position.

In some embodiments, the system further can further comprise a bag configured to at least partially surround the scoop portion and the guard portion such that the bag is at least partially within the scoop pocket. In some embodiments, the bag can comprise at least one slit. In some embodiments, the bag can comprise a pair of slits on opposite sides of the bag. In some embodiments, the bag can comprise at least one connector connecting both sides of the slit. In some embodiments, the bag can be configured to fit closely with the scoop portion, guard portion, and handle portion.

In some embodiments, the bag can comprise a first, second, and third portion each having a width and height, the third portion being closest to an opening of the bag, and the second portion being between the first and third portions, wherein the width and height of the second portion is greater than the widths and heights of the first and third portions. In some embodiments, the bag can touch the base section proximate to where the base section and guard portion connect when in the open position.

In some embodiments, the side wall sections can be rotated inward toward the base section of the scoop portion. In some embodiments, the sidewall sections can be configured to be releasably attached with the back wall section. In some embodiments, the back wall section can be rotated inward toward the base section of the scoop portion.

In some embodiments, the handle portion can comprise a clasp, the clasp configured to releasably attach to the base section of the scoop portion when in the closed position. In some embodiments, the handle portion and the back wall section can be configured to releasably attach in the open configuration so that the handle portion can rotate into the closed position. In some embodiments, the guard portion can be configured to bend inwards in the closed position.

In some embodiments, the maximum thickness of the scooping system in the closed position can be the thickness of the base section and the thick ness of the handle portion. In some embodiments, the handle portion can be configured to be hollow, and wherein the hollow handle portion is configured to retain a roll of animal waste bags. In some embodiments, the length of the scooping system in the closed position can be approximately ½ of the length of the scooping system in the open position. In some embodiments, the system in the closed position can be configured to attach to a leash. In some embodiments, the sidewall sections can be generally triangular in shape.

Also disclosed herein is a foldable scooper, said foldable scooper can comprise a scoop, the scoop having a pocket at least partially formed from a flexible guard and a base and configured to accept and retain animal waste, and a handle configured to be rotatably attached to the scoop, wherein the handle is configured to extend away from the scoop in an open position and extend towards the scoop in a closed position, wherein, when in the closed position, the foldable scoop is configured to be less than 75% of the length of the scoop in the open position.

In some embodiments, when in the closed position, the foldable scoop can be configured to be 50% or less of the length of the scoop in the open position.

In some embodiments, the foldable scooper can further comprise a bag configured to fit around the foldable scooper. In some embodiments, the bag can be configured to have a varying diameter, wherein the diameter of the bag surrounding the guard is greater than the diameter of the bag surrounding the handle. In some embodiments, the bag can comprise at least one slit from an open end and a retention portion configured to at least partially seal the at least one slit to form two slit portions.

BRIEF DESCRIPTION OF THE DRAWINGS

FIGS. 1A-B illustrate viewpoints of an embodiment of a foldable scooper in an opened position.

DETAILED DESCRIPTION

Figure 2A:
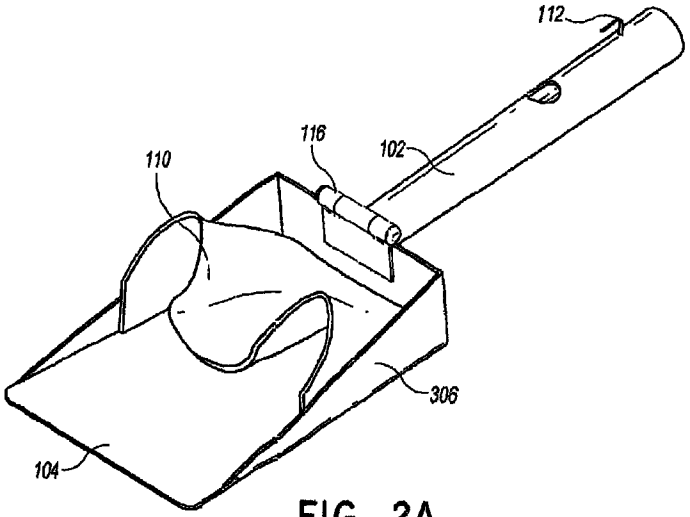
FIGS. 2A-B illustrate viewpoints of an embodiment of a foldable scooper in a closed position.

Disclosed herein are embodiments of a foldable scooper for use in cleaning up waste matter from an animal, such as a dog or cat. Embodiments of the scooper can be configured to fit with a user's pocket, such as when the user is out walking their animal.

The disclosed foldable scooper can be advantageous as it desirably is a "no touch" scooper, where a user will not come in contact with any animal waste during pick up. The walls and guards disclosed in some embodiments prevent a user from coming into contact with animal waste. Further, the disclosed scooper allows for ease of sanitary waste removable, thereby helping comply with nationwide laws regarding sanitary issues of animal waste in public areas.

Further, as the disclosed scooper is foldable, it can be compact and easily moved around, providing a portable folding scooper. In fact, in some embodiments, the disclosed scooper can fit in a user's pocket. Further, embodiments of the scooper can hold onto waste bags directly in the scooper, thus making one less item for a user to carry. In some embodiments, the disclosed scooper may not be foldable.

FIGS. 1A-B illustrate two viewpoints of an embodiment of a foldable scooper in an open position. As shown, the scooper can have a handle 102 for a user to grip. The handle 102 can be connected to a back wall 108. The back wall 108 can connect to two sidewalls 106 and a bottom 104. Accordingly, the combination of the back wall 108, sidewalls 106, and bottom 104 can form a pocket, a lining for a pocket, or a lining for a cavity 103, which can be used to retain animal waste. In some embodiments, the back wall 108, sidewalls 106 and bottom 104 can be non-releasably attached to one another. In some embodiments, the back wall 108, sidewalls 106 and bottom 104 can come together in generally curved joints. In some embodiments, the back wall 108, sidewalls 106 and bottom 104 can come together in generally angled joints.

In some embodiments, the bottom 104 can be generally rectangular in shape. In some embodiments, the bottom 104 can be generally curved to create a deeper lining for a cavity 103. In some embodiments, the bottom 104 can have a generally flat leading edge. This could be advantageous for ease of picking up animal waste. In some embodiments, the bottom 104 can have a generally pointed leading edge.

In some embodiments, a guard 110 can also be attached to the scooper. The guard 110 can further increase the size of the lining for the cavity 103. The guard 110 can extend to form an approximately 50, 60, 70, 80, 90, 100, 110, 120, 130, 140° angle with the bottom 104 in an open position, as shown in FIGS. 1A-B. In some embodiments, the guard 110 can attach to one or more portions of the scooper. For example, in some embodiments the guard 110 can attach to the sidewalls 106 and back wall 108. The attachment can be, for example, friction, clasps, or Velcro, and the attachment means does not limit the disclosure. In some embodiments, the guard 110 can attach directly to the bottom 104. In some embodiments, the guard 110 can be removable and replaceable.

In some embodiments, the guard 110 can be made of up of a back portion 204 extending generally in an angle away from the bottom 104, and two side or arm portions 206 extending in a direction transverse to the back portion 204, the back portion 204 and arm portions 206 connected by a transition surface 208. In some embodiments, the back portion 204 can be generally straight. In some embodiments, the back portion 204 can be generally curved. In some embodiments, the curved back portion 204 can curve towards the bottom 104. The transition surface 206 can be generally curved or can be straight. In some embodiments, the arm portions 206 can start from a maximum height of the guard 110 and have a progression surface 210 extending towards the bottom 104. In some embodiments, this progression surface 210 can be curved. In some embodiments, this progression surface 210 can be straight. The arm portions 206 can be configured to accommodate the nesting of the guard 110 into the scooper when in the closed position.

In some embodiments, the guard 110 can be made of the same material as the walls 106/108 and bottom 104. In some embodiments, the guard 110 can be made of a different material. For example, the guard 110 can be made of a generally softer and/or more pliable material so the guard 110 can be configured to bend and flex. For example, the guard 110 can be made of foam, rubber, or plastic, though the type of material does not limit the disclosure.

In some embodiments, the handle 102 can be connected to the back wall 108 by a hinge 116. The hinge 116 can allow the handle 102 to rotate around the scooper, as further discussed in detail below with respect to FIGS. 2A-B. In some embodiments, in the open position the handle 102 can abut the back wall 108 so that it cannot rotate any farther away from the scooper. In some embodiments, the handle 102 can be figured to releasably lock with the back wall 108 through an engagement mechanism, such as an opening and spring-loaded pin, so that the handle 102 remains in the open position unless a user decides to rotate the handle 102. The engagement mechanism does not limit the disclosure. In some embodiments, the handle 102 can be generally hollow. In some embodiments, the handle 102 can be solid. In some embodiments, the handle 102 can be generally cylindrical. In some embodiments, the handle 102 can be a half cylinder, having a rounded portion on one side and a flat portion on the opposite. In some embodiments, the handle 102 can contain grooves, roughness, or other patterns for a user to grip onto the handle 102. In some embodiments, the handle 102 can be configured to be generally angled away from the back wall 108. In some embodiments, the handle 102 can extend no higher than the maximum height of the back wall 108. In some embodiments, the handle 102 can extend from the back wall 108 generally parallel to the bottom 104.

The handle 102 can also comprise at least one aperture 114 on its surface. In some embodiments, the aperture 114 can extend fully through the handle 102 from one end to the opposite end. In some embodiments, the aperture 114 only extends through one surface of the handle 102 if the handle 102 is hollow. In some embodiments, the aperture 114 extends through two surfaces of the handle 102 if the handle 102 is hollow.

In some embodiments, the handle 112 can contain a clasp 112, or other attachment mechanism, on its surface. The clasp 112 can be configured to attach the handle 102 to the bottom 104 in the closed position, as further described in detail below.

In some embodiments, the handle 102 can be hollow and sized to accept a waste bag, or a roll of waste bags. The waste bag or roll of waste bags may be received within an open end of the handle 118 (shown in FIG. 2B) and positioned so that the waste bags can extend through aperture 114 so that a user can pull them out of the handle. Alternatively, the waste bags could be withdrawn through the open end of the handle 118.

In some embodiments, the handle 102 can be approximately 1, 2, 4, 5, 6, 7, 8, 9, 10, 11, or 12 inches. In some embodiments, the handle 102 can be less than approximately 1, 2, 4, 5, 6, 7, 8, 9, 10, 11, or 12 inches. In some embodiments, the handle 102 can be greater than approximately 1, 2, 4, 5, 6, 7, 8, 9, 10, 11, or 12 inches. In some embodiments, the handle 102 can be generally round and have a radial thickness of about 0.5, 1, 1.5, or 2 inches. In some embodiments, the handle 102 can be generally round and have a radial thickness of less than about 0.5, 1, 1.5, or 2 inches. In some embodiments, the handle 102 can be generally round and have a radial thickness of greater than about 0.5, 1, 1.5, or 2 inches. In some embodiments, the handle 102 can be rectangular and have sides having widths of approximately 0.5, 1, 1.5, or 2 inches. In some embodiments, the handle 102 can be rectangular and have sides having widths of less than approximately 0.5, 1, 1.5, or 2 inches. In some embodiments, the handle 102 can be rectangular and have sides having widths of greater than approximately 0.5, 1, 1.5, or 2 inches.

In some embodiments, the bottom 104 can be approximately 1, 2, 4, 5, 6, 7, 8, 9, 10, 11, or 12 inches in length. In some embodiments, the bottom 104 can be greater than approximately 1, 2, 4, 5, 6, 7, 8, 9, 10, 11, or 12 inches in length. In some embodiments, the bottom 104 can be less than approximately 1, 2, 4, 5, 6, 7, 8, 9, 10, 11, or 12 inches in length. In some embodiments, the bottom 104 can be approximately 1, 2, 4, 5, 6, 7, 8, 9, 10, 11, or 12 inches in width. In some embodiments, the bottom 104 can be greater than approximately 1, 2, 4, 5, 6, 7, 8, 9, 10, 11, or 12 inches in width. In some embodiments, the bottom 104 can be less than approximately 1, 2, 4, 5, 6, 7, 8, 9, 10, 11, or 12 inches in width.

In some embodiments, the handle 102 can be approximately the same length as the length of the bottom 104. In some embodiments, the handle 102 can be longer than the length of the bottom 104. In some embodiments, the handle 102 can be about 1, 2, 4, 5, 6, 7, 8, 9, 10, 11, or 12 inches longer. In some embodiments, the handle 102 can be greater than about 1, 2, 4, 5, 6, 7, 8, 9, 10, 11, or 12 inches longer. In some embodiments, the handle 102 can be less than about 1, 2, 4, 5, 6, 7, 8, 9, 10, 11, or 12 inches longer. In some embodiments, the ratio between the lengths of the handle 102 to the length of the bottom 104 can be about 1:1, 1.1:1, 1.2:1, 1.3:1, 1.4:1, 1.5:1, 1.6:1, 1.7:1, 1.8:1, 1.9:1 or 2:1.

In some embodiments, the back wall 108 can be approximately 1, 2, 4, 5, 6, 7, 8, 9, 10, 11, or 12 inches in width. In some embodiments, the back wall 108 can be greater than approximately 1, 2, 4, 5, 6, 7, 8, 9, 10, 11, or 12 inches in width. In some embodiments, the back wall 108 can be less than approximately 1, 2, 4, 5, 6, 7, 8, 9, 10, 11, or 12 inches in width. In some embodiments, the back wall 108 can be approximately 1, 2, 4, 5, or 6 inches in height. In some embodiments, the back wall 108 can be greater than approximately 1, 2, 4, 5, or 6 inches in height. In some embodiments, the back wall 108 can be less than approximately 1, 2, 4, 5, or 6 inches in height.

In some embodiments, the sidewalls 106 can be approximately 1, 2, 4, 5, or 6 inches in length the maximum height. In some embodiments, the sidewalls 106 can be greater than approximately 1, 2, 4, 5, or 6 inches in length at the maximum height. In some embodiments, the back wall 108 can be less than approximately 1, 2, 4, 5, or 6 inches in length. In some embodiments, the sidewalls 106 can be approximately 1, 2, 4, 5, 6, 7, 8, 9, 10, 11, or 12 inches in length. In some embodiments, the sidewalls 106 can be greater than approximately 1, 2, 4, 5, 6, 7, 8, 9, 10, 11, or 12 inches in length. In some embodiments, the sidewalls 106 can be less than approximately 1, 2, 4, 5, 6, 7, 8, 9, 10, 11, or 12 inches in length. In some embodiments, the sidewalls 106 can be generally rectangular. In some embodiments, the sidewalls 106 can be generally triangular in shape, wherein the larges height is connected to the back wall 108. In some embodiments, the sidewall 106 can attach to the back wall 108 at approximately the same height. In some embodiments, the sidewall 106 can attach to the back wall 108 at a different height. In some embodiments, the triangular sidewalls 106 can end at the front end of the bottom 104. In some embodiments, the triangular sidewalls 106 can extend to about 0.5, 1.0, 1.5, 2.0, 2.5, or 3.0 inches from the front end of the bottom 104. In some embodiments, the triangular sidewalls 106 can extend to greater than about 0.5, 1.0, 1.5, 2.0, 2.5, or 3.0 inches from the front end of the bottom 104. In some embodiments, the triangular sidewalls 106 can extend to less than about 0.5, 1.0, 1.5, 2.0, 2.5, or 3.0 inches from the front end of the bottom 104. In some embodiments, both sidewalls 106 can extend approximately the same distance. In some embodiments, the sidewalls 106 can extend different distances.

In some embodiments, the ratio between the height of the bottom 104 to the height of the back wall 108 is 1:1; 1.5:1, 2:1, 2.5:1, 3:1, 3.5:1, 4:1, 4.5:1, 5:1, 5.5:1, 6:1, 6.5:1, or 7:1. In some embodiments, the ratio between the height of the bottom 104 to the maximum height of the sidewalls 106 is 1:1; 1.5:1, 2:1, 2.5:1, 3:1, 3.5:1, 4:1, 4.5:1, 5:1, 5.5:1, 6:1, 6.5:1, or 7:1. In some embodiments, the ration between the length of the sidewall 106 to the width of the back wall 108 is 0.5:1; 0.7:1, 1:1, 1.3:1, 1.5:1; 1.7:1, or 2:1.

In some embodiments, the back wall 108, sidewalls 106, and bottom 104 can have a thickness of approximately 0.1, 0.2, 0.3, 0.4, 0.5, 0.6, 0.7, 0.8, 0.9, or 1.0 inches. In some embodiments, the back wall 108, sidewalls 106, and bottom 104 can have a thickness of greater than approximately 0.1, 0.2, 0.3, 0.4, 0.5, 0.6, 0.7, 0.8, 0.9, or 1.0 inches. In some embodiments, the back wall 108, sidewalls 106, and bottom 104 can have a thickness of less than approximately 0.1, 0.2, 0.3, 0.4, 0.5, 0.6, 0.7, 0.8, 0.9, or 1.0 inches.

In some embodiments, the aperture 114 can be generally circular or oval-shaped. In some embodiments, the aperture 114 can have a radius of about 0.5, 0.75, 1, 1.25, 1.5, 1.75, 2, 2.25, 2.5, 2.75, or 3 inches. In some embodiments, the aperture 114 can have a radius of greater than about 0.5, 0.75, 1, 1.25, 1.5, 1.75, 2, 2.25, 2.5, 2.75, or 3 inches. In some embodiments, the aperture 114 can have a radius of less than about 0.5, 0.75, 1, 1.25, 1.5, 1.75, 2, 2.25, 2.5, 2.75, or 3 inches. In some embodiments, the aperture 114 can contain different sized radii.

In some embodiments, the guard 110 can have a back portion 304 with a width of approximately, 1, 2, 3, 4, 5, 6, 7, 8, 9, 10, 11, or 12 inches. In some embodiments, the guard 110 can have a back portion 304 with a width of greater than approximately, 1, 2, 3, 4, 5, 6, 7, 8, 9, 10, 11, or 12 inches. In some embodiments, the guard 110 can have a back portion 304 with a width of less than approximately, 1, 2, 3, 4, 5, 6, 7, 8, 9, 10, 11, or 12 inches. In some embodiments, the guard 110 can have a back portion 304 with a width approximately the same as the back wall 108. In some embodiments, the guard 110 can have a back portion 304 with a height of approximately, 1, 2, 3, 4, 5, or 6 inches. In some embodiments, the guard 110 can have a back portion 304 with a height of greater than approximately, 1, 2, 3, 4, 5, or 6 inches. In some embodiments, the guard 110 can have a back portion 304 with a height of less than approximately, 1, 2, 3, 4, 5, or 6 inches. In some embodiments, the guard 110 can have a back portion 304 with a height approximately the same as the length of bottom 104. In some embodiments, the arms portions 206 can extend about 1, 2, 3, 4, 5, or 6 inches from the back portion 304. In some embodiments, the arms portions 206 can extend greater than about 1, 2, 3, 4, 5, or 6 inches from the back portion 304. In some embodiments, the arms portions 206 can extend less than about 1, 2, 3, 4, 5, or 6 inches from the back portion 304. In some embodiments, the back portion 304 of the guard can have a height of about 0%, 5%, 10%, 15%, or 20% less than the length of the bottom 104 in the closed position. In some embodiments, the back portion 304 of the guard can have a height of about 0%, 5%, 10%, 15%, or 20% greater than the length of the bottom 104 in the closed position. In some embodiments, the back portion 304 of the guard 110 can have a height of about 100%, 150%, 200%, 250%, 300%, 350%, 400%, 450%, or 500% greater than the height of the back wall 108 when the scooper is in the open position.

Figure 2B:
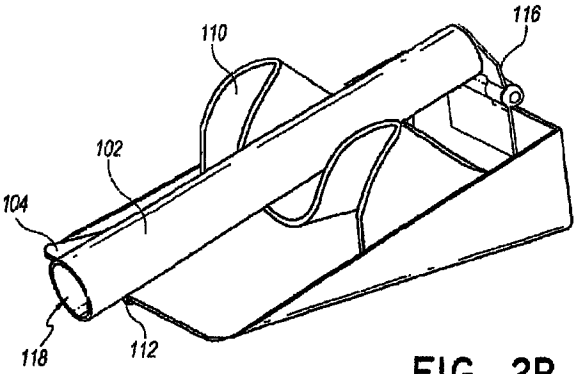

FIGS. 2A-B illustrate embodiments of the foldable scooper described above with respect to FIGS. 1A-B in a closed position. As shown in FIG. 2A, the guard 110 can be configured to be flexible, and thus be bent inwards toward the bottom 104 when an outside force, such as a user's hand, is applied. The guard 110 can be configured to maintain the bent position, or can be configured to return to the original position once a force is lifted from the guard 110. In some embodiments, the guard 110 can be folded completely flat. In some embodiments, the guard 110 can have portions that extend above the sidewalls 306.

As shown in FIG. 2B, the handle 102 can be rotated over the scooper so that it can face the front edge of the bottom 104 through the use of hinge 116. In some embodiments, the flipping of the handle 102 can press exert the external force and push down the guard 110, and so no addition force may be needed. The clasp 112 of the handle can be used to attach the handle 102 to the bottom 104, and therefore the handle 102 can remain in the closed position until a user releases the handle 102. The clasp 112 can be generally flexible so that it can be clipped onto the bottom 104 and remain in position. In some embodiments, the clip 112 can be a male or female engagement element, and the bottom 104 can contain the opposite male or female engagement element. Therefore, the two engagement elements can attach to one another in the closed position. The type of attachment does not limit the disclosure. The clasp 112 can also be configured to releasably attach a leash, so the foldable scooper can be hands free.

The disclosed closed position can reduce the length of the scooper by about 10, 20, 30, 40, 50, 60, or 70% from the open position. The disclosed closed position can reduce the length of the scooper by more than about 10, 20, 30, 40, 50, 60, or 70% from the open position.

Figure 3A:
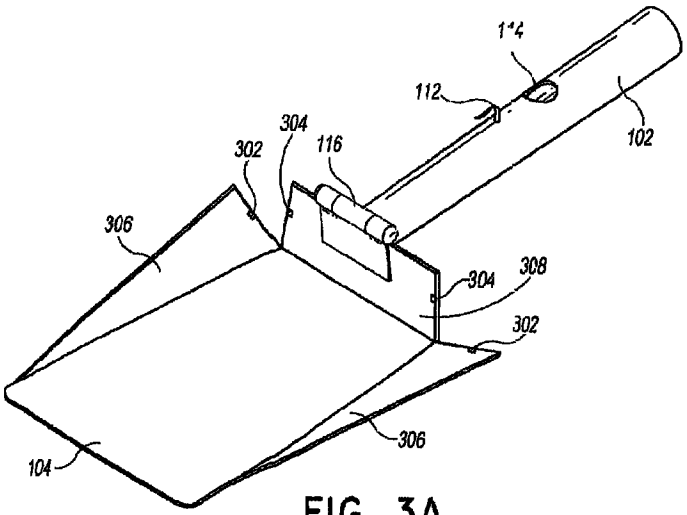
FIGS. 3A-B illustrate viewpoints of an embodiment of a foldable scooper where all sides are foldable.
Figure 3B:
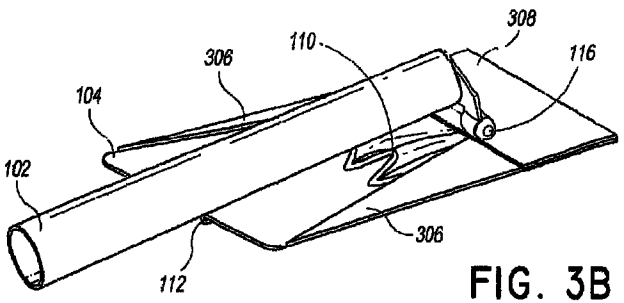

FIGS. 3A-B illustrate an embodiment of a foldable scooper with additional folding features. The scooper can be sized and configured similar to the scooper described with respect to FIGS. 1A-B.

As shown in FIG. 3A, in some embodiments, the sidewalls 306 and back wall 308 can be configured to rotatably attach to bottom 104. In some embodiments, the sidewalls 306 and back wall 308 can be attached to the bottom 104 through, for example, a hinge. In some embodiments, the sidewalls 306 and back wall 308 can be flexibly attached to the bottom 104 so that they can be configured to flexibly rotate inwards towards the bottom 104. As shown in FIG. 3A, the sidewalls 306 and or back wall 308 can be configured to rotate into the same plane as the bottom 104. In some embodiments, the sidewalls 306 and the bottom 104 can be configured to form a rotatable angle of about 0, 5, 10, 20, 30, 40, 50, 70, 70, 80, 90, 100, 110, 120, 130, 140, 150, 160, 170, 180, or 190°. In some embodiments, the back wall 308 and the bottom 104 can be configured to form a rotatable angle of about 0, 5, 10, 20, 30, 40, 50, 70, 70, 80, 90, 100, 110, 120, 130, 140, 150, 160, 170, 180, or 190°.

In some embodiments, the sidewalls 306 can be releasably attached to the back wall 308. For example, the sidewalls 306 can have an engagement mechanism 302 that attaches to an engagement mechanism 304 on the back wall 308. The engagement mechanisms 302/304 can be configured to be male/female engagement mechanisms. In some embodiments, the sidewalls 306 and back wall 308 each have one engagement mechanism 302/304. In some embodiments, the sidewalls 306 and back wall 308 each have more than one engagement mechanism 302/304. In some embodiments, the sidewalls 306 and back wall 308 each have 1, 2, 3, 4, or 5 engagement mechanisms 302/304. In some embodiments, the engagement mechanisms 302/304 can be on the inside of the scooper. In some embodiments, the engagement mechanisms 302/304 can be on the outside of the scooper.

FIG. 3B illustrates a closed configuration of the foldable scooper shown in FIG. 3A. As shown, the sidewalls 306 can rotate inwards towards the bottom 104. The sidewalls 306 can be above or below the guard 110 in the closed position. In some embodiments, the sidewalls 306 can compress the guard 110 along with the handle 102. The back wall 308 and the handle 102 can both rotate towards the bottom 104 as well, either separately or together.

Accordingly, the closed configuration of the scooper can have a minimal height, thereby increasing the ease in putting the scooper in a user's pocket. In some embodiments, the scooper can have a total height of about 1, 2, 3, 4, 5, or 6 inches in the closed configuration. In some embodiments, the scooper can have a total height of greater than about 1, 2, 3, 4, 5, or 6 inches in the closed configuration. In some embodiments, the scooper can have a total height of less than about 1, 2, 3, 4, 5, or 6 inches in the closed configuration.

Figure 4:
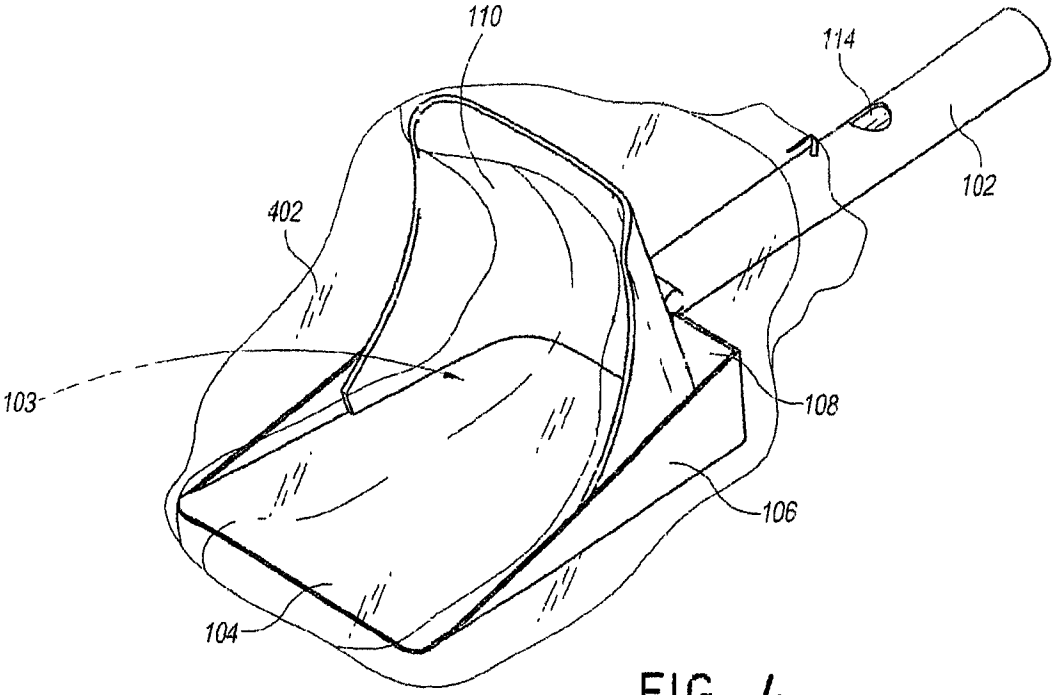
FIG. 4 illustrates an embodiment of a foldable scooper with an attached bag.

FIG. 4 shows an embodiment of a foldable scooper with a bag 402 surrounding the scooper. As shown, the bag 402 can fit around the bottom 104, the guard 110. The bag 402 can fit at least partially around the handle 102. Accordingly, a user can hold onto the edge of the bag 402 around the handle. A user can then press in the bag to form a lining for cavity 103 between the bottom 104 and guard 110. A user can then scoop up animal waste so that the animal waste falls within the lining for the cavity 103. When the scooper is lifted up, the guard 110 and bottom 104 can prevent the waste from moving. A user can then pull the edge of the bag 402 away from the handle, thus encasing the waste in the bag 402. Accordingly, the user will not come into contact with the animal waste. In some embodiments, the bag 402 can be custom sized to fit over the foldable scooper. In some embodiments, the bag 402 can be about ¼, ½, or ¾ of the length of the scooper when opened. Further, the guard 110 and sidewalls 106/306 allow for a user to go from a horizontal position to a vertical position while preventing rolling of any waste over the sides. A user can move the scooper with one hand and pull the bag 402 over the waste with the other hand.

In some embodiments, a Velcro strap can be attached to a portion of the scooper. Accordingly, the strap can circumscribe a leash and attach the scooper to the leash, allowing it to be hands free.

Figure 5B:
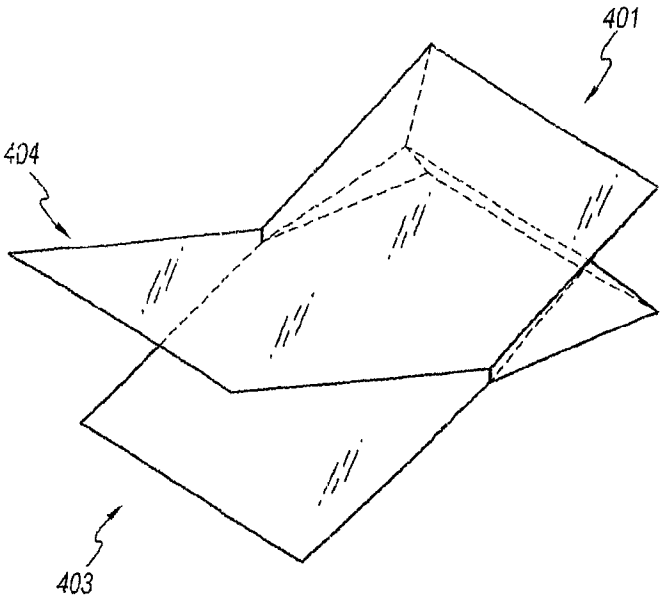
FIGS. 5A-B illustrate viewpoints of an embodiment of a bag configured for use on a foldable scooper.
Figure 5A:
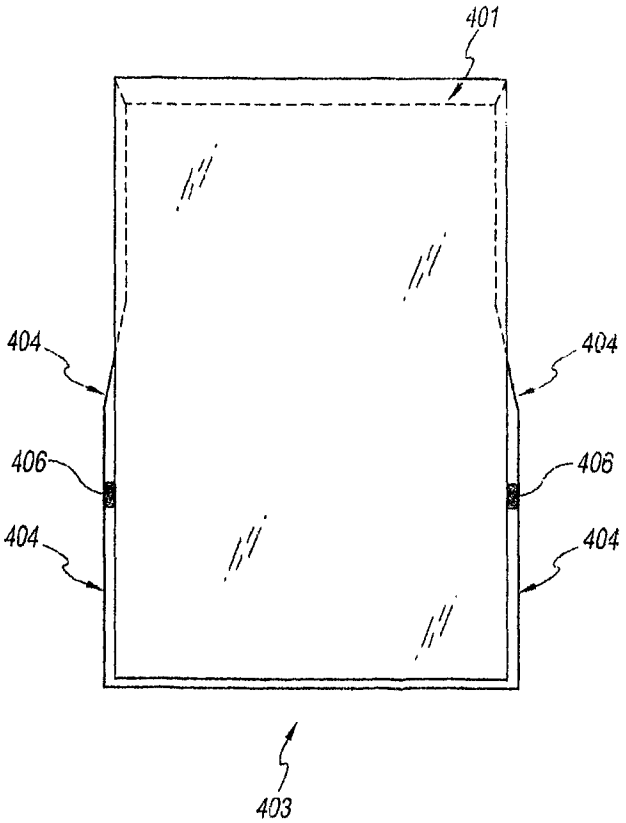

FIGS. 5A-B show an embodiment of a bag 402 sized and configured to fit on the foldable scooper. In some embodiments, the bag 402 can be custom fit over the scooper. As shown, the bag 402 can have closed end 401 and an open end 403. In some embodiments, the bag 402 can fit closely over the foldable scooper. For example, in some embodiments, the bag 402 can have a cross-sectional area about 5, 10, 15, 20, 25, 30, 35, 40, 45, or 50% greater than the largest portion of the cross sectional area of guard 110 around the guard when the foldable scooper is in the open position. In some embodiments, the bag 402 can have a cross-sectional area less than about 5, 10, 15, 20, 25, 30, 35, 40, 45, or 50% greater than the largest portion of the cross sectional area of guard 110 when the foldable scooper is in the open position. In some embodiments, the bag 402 can vary in dimensions. For example, in some embodiments, at the handle 102, the bag 402 can have a cross-sectional area about 5, 10, 15, 20, 25, 30, 35, 40, 45, or 50% less than the largest portion of the cross sectional area of guard 110 and/or the largest cross-sectional area of the bag when the scooper is generally in the open position.

In some embodiments, the bag 402 can contain at least one slit 404. The slit 404 can extend from the open end 403 towards the closed end 401. In some embodiments, 1, 2, 3, 4, 5, or 6 slits 404 can be used. In some embodiments, a pair of slits 404 on opposite sides of the bag can be used 402, so that the closed end 401 is divided into a first, or upper, portion and a second, or lower, portion. In some embodiments, the upper portion of the bag 402 can be slightly larger than the guard 110 and the bottom portion of the bag 402 can be slightly larger than the bottom 104 when the foldable scooper is in the open position. In some embodiments, the upper portion of the bag 402 can have a cross-sectional width of about 5, 10, 15, 20, 25, 30, 35, 40, 45, or 50% greater than the largest cross sectional width of guard 110 when the foldable scooper is in the open position. In some embodiments, the upper portion of the bag 402 can have a cross-sectional width of less than about 5, 10, 15, 20, 25, 30, 35, 40, 45, or 50% greater than the largest cross sectional width of guard 110 when the foldable scooper is in the open position. In some embodiments, the lower portion of the bag 402 can have a cross-sectional width of about 5, 10, 15, 20, 25, 30, 35, 40, 45, or 50% greater than the largest cross sectional width of bottom 104 when the foldable scooper is in the open position. In some embodiments, the lower portion of the bag 402 can have a cross-sectional width of less than about 5, 10, 15, 20, 25, 30, 35, 40, 45, or 50% greater than the largest cross sectional width of bottom 104 when the foldable scooper is in the open position.

The use of slits 404 in the bag 402 can be advantageous over other bags. This can allow for some give when maneuvering the bag, thus preventing some tears. In some embodiments, the slit 404 can allow a user to swing the bag 402 over the scooper without restriction with one hand. Further, this can clear any debris on the bottom 104. The slit 404 can be advantageous as it can ease the difficulty of opening the bag 402, which is a common problem. A user can pull the bag 402 at the portions next to the slit 404 around the scooper, thus easily surrounding any animal waste in the scooper without coming into contact with it. In addition, the slit 404 can make it easier to tie off the bag 402 once used. In some embodiments, the slit 404 can be about 0.5, 1, 1.5, 2, 2.5, or 3 inches in length. In some embodiments, the slit 404 can be greater than about 0.5, 1, 1.5, 2, 2.5, or 3 inches in length. In some embodiments, the slit 404 can be less than about 0.5, 1, 1.5, 2, 2.5, or 3 inches in length.

In some embodiments, the slit 404 can have a seal, retention portion, or strip 406. This seal can be located approximately midpoint of the slit 404, though this does not limit the disclosure. The seal 406 can be about ⅛, ⅙, ¼, or ½ inch in thickness. The seal 406 can be greater than about ⅛, ⅙, ¼, or ½ inch in thickness. The seal 406 can be less than about ⅛, ⅙, ¼, or ½ inch in thickness. The seal 406 can be used to hold the slit 404 together until a user wants to use the bag 402. The seal 406 can then be broken, thereby forming a larger slit 404.

In a number of embodiments, the portable scooping system' utility is desirably not restricted to pet usage. There are various forms of waste that a no touch portable scooping system would aide in disposing. For example, in a household/commercial setting, while cleaning, rather than scooping waste into an ordinary dust pan, a larger s portable scooping system would desirably maintain cleanliness and avoid contamination due to remains. In a household/commercial kitchen, for example, a mid-size version could scoop excess food (meat, poultry, vegetables etc.) encase it in the bag and toss. In a hospital or laboratory, hazardous waste could desirably be contained without touch. Generally, the portable scooping system desirably allows the user to easily isolate waste. The ability to isolate waste has several advantages such as the sanitary containment to avoid contaminant of rot, smell, toxicity, germs, hazardous/human/animal waste, fluids etc. Furthermore, this containment helps separate contamination and therefore becomes an advocate of recycling, hazard, sanitary and earth conscious laws, expectations and safety precautions set in various industries of businesses, public applications including human/animal health safety. In addition to the guard safety feature, the appropriate fit of the bag on the scoop desirably provides containment in the selected application.

The scoop device can be made in various materials such as plastic, stainless steel, carbon fiber and other metals. These materials may be perforated to reduce weight or to create a design relative to pet identification or household, commercial, medical identification or application. The portable scooping system may have various colors, patterns, textures, clear, opaque, etc.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

Although the foregoing description has shown, described, and pointed out the fundamental novel features of the present teachings, it will be understood that various omissions, substitutions, and changes in the form of the detail of the apparatus as illustrated, as well as the uses thereof, may be made by those skilled in the art, without departing from the scope of the present teachings. Consequently, the scope of the present teachings should not be limited to the foregoing discussion, but should be defined by the appended claims.

What is claimed is:

1. A portable scooping system, said system comprising:

a scoop portion comprising:

a back wall section;

at least two side wall sections connected to the back wall section; and at least one base section connecting the back wall section and the at least two side wall sections;

a guard portion configured to extend at least partially over the scoop portion to create a pocket formed between the sidewall sections and base section of the scoop portion and the guard portion;

a handle portion configured to rotatably connect with the back wall section; wherein the handle portion is configured to extend generally away from the scoop portion in an open position, and is configured to nest generally in the scoop portion in the closed position; and wherein the side wall sections are configured to be rotated inwardly toward the base section of the scoop portion.

2. The portable scooping system of claim 1, the system further comprising a bag configured to at least partially surround the scoop portion and the guard portion such that the bag is at least partially within the scoop pocket.

3. The portable scooping system of claim 2, wherein the bag comprises at least one connector connecting both sides of the slit.

4. The portable scooping system of claim 2, wherein the bag is configured to fit closely with the scoop portion, guard portion, and handle portion.

5. The portable scooping system of claim 2, wherein the bag comprises a first, second, and third portion each having a width and height, the third portion being closest to an opening of the bag, and the second portion being between the first and third portions, wherein the width and height of the second portion is greater than the widths and heights of the first and third portions.

6. The portable scooping system of claim 5, wherein the bag touches the base section proximate to where the base section and guard portion connect when in the open position.

7. The portable scooping system of claim 1, wherein the bag comprises at least one slit.

8. The portable scooping system of claim 7, wherein the bag comprises a pair of slits on opposite sides of the bag.

9. The portable scooping system of claim 1, wherein the sidewall sections are configured to be releasably attached with the back wall section.

10. The portable scooping system of claim 1, wherein the back wall section is configured to be rotated inwardly toward the base section of the scoop portion.

11. The portable scooping system of claim 1, wherein the handle portion comprises a clasp, the clasp configured to releasably attach to the base section of the scoop portion when in the closed position.

12. The portable scooping system of claim 1, wherein the handle portion and the back wall section are configured to releasably attach in the open configuration so that the handle portion can rotate into the closed position.

13. The portable scooping system of claim 1, wherein the guard portion is configured to bend inwards in the closed position.

14. The portable scooping system of claim 1, wherein the maximum thickness of the scooping system in the closed position is the thickness of the base section and the thickness of the handle portion.

15. The portable scooping system of claim 1, wherein the handle portion is configured to be hollow, and wherein the hollow handle portion is configured to retain a roll of animal waste bags.

16. The portable scooping system of claim 1, wherein the length of the scooping system in the closed position is approximately ½ of the length of the scooping system in the open position.

17. The portable scooping system of claim 1, wherein the sidewall sections are generally triangular in shape.

18. A foldable scooper, said foldable scooper comprising:

a scoop, the scoop having a pocket at least partially formed from a flexible guard configured to accept and retain animal waste;

a back wall section;

at least two side wall sections connected to the back wall section; and at least one base section connecting the back wall section and the at least two side wall sections;

the flexible guard configured to extend at least partially over the scoop, wherein the pocket formed between the sidewall sections and base section of the scoop and the flexible guard; and a handle portion configured to rotatably connect with the back wall section; wherein the handle portion is configured to extend generally away from the scoop in an open position, and is configured to nest generally in the scoop in the closed position; and wherein the side wall sections are configured to be rotated inwardly towards the base section of the scoop;

furthermore, the handle portion can be configured to extend away from the scoop in an open position and extend towards the scoop in a closed position;

wherein, when in the closed position, the foldable scoop is configured to be less than 75% of the length of the scoop in the open position.

19. The foldable scooper of claim 18, wherein, when in the closed position, the foldable scoop is configured to be 50% or less of the length of the scoop in the open position.

20. The foldable scooper of claim 18, further comprising a bag configured to fit around the foldable scooper.

21. The foldable scooper of claim 20, wherein the bag is configured to have a varying diameter, wherein the diameter of the bag surrounding the guard is greater than the diameter of the bag surrounding the handle.

22. The foldable scooper of claim 20, wherein the bag comprises at least one slit from and open end and a retention portion configured to at least partially seal the at least one slit to form two slit portions.

* * * * *